US005165494A

United States Patent [19]

Barr

[11] Patent Number: 5,165,494

[45] Date of Patent: Nov. 24, 1992

[54] ROTARY DRILLS BITS

[75] Inventor: John D. Barr, Cheltenham, England

[73] Assignee: Camco Drilling Group Ltd., Yiewsley, Northern Ireland

[21] Appl. No.: 616,582

[22] Filed: Nov. 21, 1990

[30] Foreign Application Priority Data

Nov. 25, 1989 [GB] United Kingdom ..... 8926688

[51] Int. Cl.[5] ..... E21B 10/00

[52] U.S. Cl. ..... 175/376; 175/399

[58] Field of Search ..... 175/329, 336, 343, 350, 175/351, 353, 376, 398, 399

[56] References Cited

U.S. PATENT DOCUMENTS 4,982,802 1/1991 Warren et al. ..... 175/399 X

OTHER PUBLICATIONS

"Bit Whirl-A New Theory of PDC Bit Failure", paper no. SPE 15971, by J. F. Brett, T. M. Warren and S. M. Behr, Society of Petroleum Engineers, 64th Annual Technical Conference, San Antonio, Tex., Oct. 8-11, 1989.

"Development of a Whirl Resistant Bit", paper No. 19572, by T. M. Warren, Society of Petroleum Engineers, 64th Annual Technical Conference, San Antonio, Tex., Oct. 8-11, 1989.

*Primary Examiner*—William P. Neuder

[57] ABSTRACT

A rotary drill bit comprises a bit body having a shank for connection to a drill string and a passage for supplying drilling fluid to the face of the bit, which carries a plurality of polycrystalline diamond preform cutting elements. The cutting elements are mounted on a single radially extending blade so that the bit is imbalanced and a resultant sideways force is applied to the bit as it rotates during drilling. The gauge of the bit body is provided with a low friction bearing pad which extends rearwardly of the blade and transmits the resultant sideways force to the sides of the bore hole. Since the bearing pad is low friction, it slides around the surface of the formation and any tendency for bit whirl to be initiated is reduced.

4 Claims, 2 Drawing Sheets

ROTARY DRILLS BITS

BACKGROUND OF THE INVENTION

The invention relates to rotary drill bits for use in drilling or coring holes in subsurface formations, and particularly to polycrystalline diamond compact (PDC) drag bits.

A rotary drill bit of the kind to which the present invention relates comprises a bit body having a shank for connection to a drill string and a passage for supplying drilling fluid to the face of the bit, which carries a plurality of preform cutting elements each formed, at least in part, from polycrystalline diamond. One common form of cutting element comprises a tablet, usually circular or part-circular, made up of a superhard table of polycrystalline diamond, providing the front cutting face of the element, bonded to a substrate which is usually of cemented tungsten carbide.

The bit body may be machined from solid metal, usually steel, or may be moulded using a powder metallurgy process in which tungsten carbide powder is infiltrated with metal alloy binder in a furnace so as to form a hard matrix.

While such PDC bits have been very successful in drilling relatively soft formations, they have been less successful in drilling harder formations and soft formations which include harder occlusions or stringers. Although good rates of penetration are possible in harder formations, the PDC cutters suffer accelerated wear and bit life can be too short to be commercially acceptable.

Recent studies have suggested that the rapid wear of PDC bits in harder formations is due to chipping of the cutters as a result of impact loads caused by vibration, and that the most harmful vibrations can be attributed to a phenomenon called "bit whirl". ("Bit Whirl—A New Theory of PDC Bit Failure"—paper No. SPE 15971 by J.F. Brett, T.M. Warren and S.M. Behr, Society of Petroleum Engineers, 64th Annual Technical Conference, San Antonio, Oct. 8-11, 1980). Bit whirl arises when the instantaneous axis of rotation of the bit precesses around the central axis of the hole when the diameter of the hole becomes a slightly larger than the diameter of the bit. When a bit begins to whirl some cutters can be moving sideways or backwards relatively to the formation and may be moving at much greater velocity than if the bit were rotating truly. Once bit whirl has been initiated, it is difficult to stop since the forces resulting from the bit whirl, such as centrifigual forces, tend to reinforce the effect.

Attempts to inhibit the initiation of bit whirl by constraining the bit to rotate truly, i.e., with the axis of rotation of the bit coincident with the central axis of the hole, have not been particularly successful.

Although it is normally considered desirable for PDC drill bits to be rotationally balanced, in practice some imbalance is tolerated. Accordingly, it is fairly common for PDC drill bits to be inherently imbalanced, i.e. when the bit is being run there is, due to the cutting, hydraulic and centrifugal forces acting on the bit, a resultant force acting on the bit, the lateral component of which force, during drilling, is balanced by an equal and opposite reaction from the sides of the borehole.

This resultant lateral force is commonly referred to as the bit imbalance force and is usually represented as a percentage of the weight-on-bit since it is almost directly proportional to weight-on-bit. It has been found that certain imbalanced bits are less susceptible to bit whirl than other, more balanced bits. ("Development of a Whirl Resistant Bit"—paper No. SPE 19572 by T.M. Warren, Society of Petroleum Engineers, 64th Annual Technical Conference, San Antonio, Oct. 8-11, 1988). Investigation of this phenomenon has suggested that in such less susceptible bits the resultant lateral imbalance force is directed towards a portion of the bit gauge which happens to be free of cutters and which is therefore making lower "frictional" contact with the formation and other parts of the gauge of the bit on which face gauge cutters are mounted. It is believed that, since a comparatively low friction part of the bit is being urged against the formation by the imbalance force, slipping occurs between this part of the bit and the formation and the rotating bit therefore has less tendency to process, or "walk", around the hole, thus initiating bit whirl.

(Although, for convenience, reference is made herein to "frictional" contact between the bit gauge and formation, this expression is not intended to be limited only to rubbing contact, but should be understood to include any form of engagement between the bit gauge and formation which applies a restraining force to rotation of the bit. Thus, it is intended to include, for example, engagement of the formation by any cutters or abrasion elements which may be mounted on the part of the gauge being referred to.)

This has led to the suggestion, in the abovementioned paper by Warren, that bit whirl might be reduced by omitting cutters from one sector of the bit face, so as deliberately to imbalance the bit, and providing a low friction pad on the bit body for engaging the surface of the formation in the region towards which the resultant lateral force due to the imbalance is directed.

Experimental results have indicated that this approach may be advantageous in reducing or eliminating bit whirl. The present invention relates to an arrangement for providing the necessary imbalance in such a bit.

SUMMARY OF THE INVENTION

According to the invention there is provided a rotary drill bit comprising a bit body having a shank for connection to a drill string and a passage for supplying drilling fluid to the face of the bit, which carries a plurality of preform cutting elements each formed, at least in part, from polycrystalline diamond, the bit body being formed with a single blade extending outwardly away from the central rotational axis of the bit body, at least the majority of said cutting elements being disposed side-by-side along said blade, and the gauge of the bit body including at least one low friction bearing pad so located as to transmit the resultant radial force acting on the bit, in use, to the part of the formation which the bearing pad is for the time being engaging.

Use of study a single cutter-carrying blade necessarily results in the required imbalance of the bit, and transmission of the resultant sideways force to the formation through low friction bearing pads reduces or prevents any tendency for bit whirl to be initiated.

Furthermore, the use of a single blade carrying out all most, of the cutting elements has the advantage that the structure behind the cutting elements, supporting them, can be made very strong. This, combined with the anti-whirl characteristics of the bit, enables the bit to make a very deep cut during each revolution, thus resulting in lower specific energy, i.e. higher efficiency, of the bit.

The single blade any extend substantially radially with respect to the axis of rotation of the bit.

Preferably the low friction bearing pad extends around the gauge rearwardly of the blade, with respect to the normal direction of forward drilling rotation of the bit, and the leading edge of the low friction bearing pad is in the vicinity of the outer extremity of said single blade.

The angular extent of the low friction bearing pad, around the gauge, is preferably in the range of 100° to 225°.

BRIEF DESCRIPTION OF THE DRAWINGS

Referring to FIGS. 1 and 2, these show a prior art full bore PDC drill bit.

DETAILED DESCRIPTION OF THE PREFERRED EMBODIMENT

Figure 1:
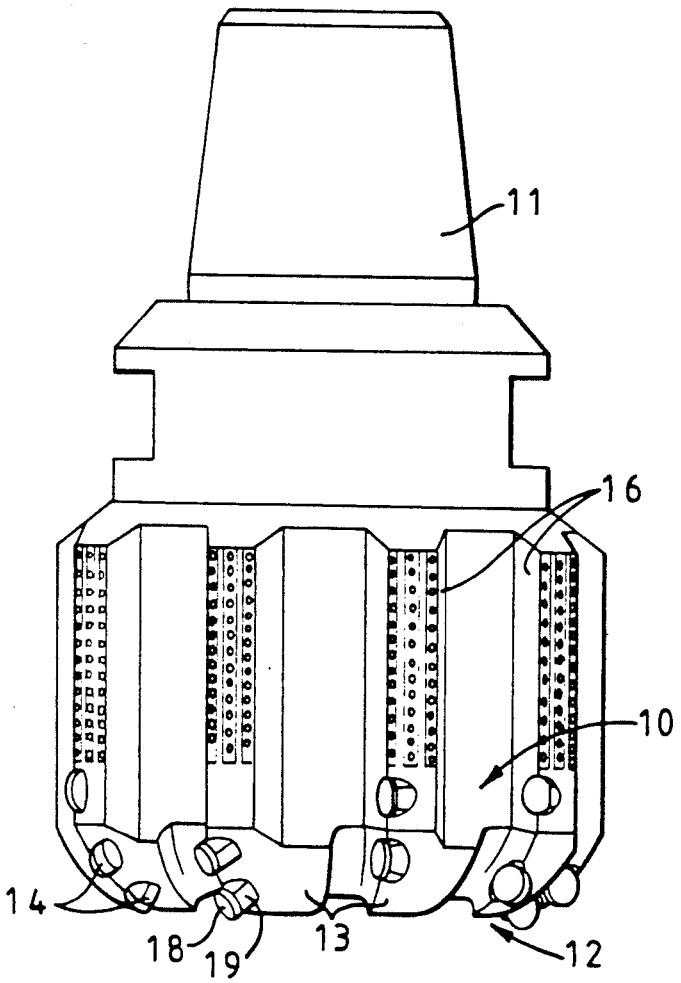
FIG 1 (PRIOR ART)
FIG. 1 is a side elevation of a typical prior art PDC drill bit.

The bit body 10 is typically moulded from tungsten carbide matrix infiltrated with a binder alloy, and has a steel shank having at one end a threaded pin 11 for connection to the drill string. The operative end face 12 of the bit body is formed with a number of blades 13 radiating from the central area of the bit, the blades carrying cutting structures 14 spaced apart along the length thereof.

The bit gauge section 15 includes kickers 16 which contact the walls of the borehold to stabilize the bit in the borehole. A central passage (not shown) in the bit body and the shank delivers drilling fluid through nozzles 17 to the end face 12 in known manner.

It will be appreciated that this is only one example of many possible variations of type of PDC bit, including bits where the body is machined from steel.

Figure 2:
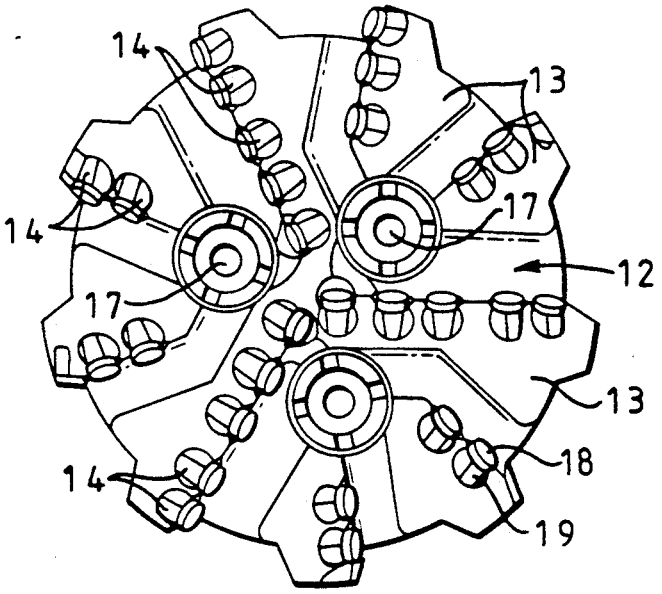
FIG 2 (PRIOR ART)
FIG. 2 is an end elevation of the drill bit shown in FIG. 1.

In many such drill bits and in the bit shown in FIGS. 1 and 2, each cutting structure 14 comprises a circular preform cutting element mounted on a carrier in the form of a stud which is secured, for example by brazing or shrink fitting, in a socket in the bit body. Each cutting element typically comprises a thin table of polycrystalline diamond bonded to a less hard substrate, usually tungsten carbide, the substrate in turn being bonded to the carrier.

A prior art drill bit of the kind shown in FIGS. 1 and 2 is normally designed so as to be substantially balanced, that is to say so that the radial components of the forces acting on the bit during drill operations substantially cancel out so as to leave no net lateral force acting on the bit. In practice, however, due to manufacturing tolerances and the unpredictability of certain of the forces acting on the bit, complete balance is difficult to achieve and most bits are imbalanced to a certain extent. According to the above-mentioned paper by Warren, 10% imbalance is typical, and values greater than 15% are not unusual. As a result, one part of the gauge section of the bit, in the direction of the imbalance force, tends to be urged towards the formation. Since kickers 16 carrying abrasion elements are disposed equally around the whole periphery of the bit, the portion of the gauge urged against the formation by the imbalance force engages the formation with high frictional contact and, as previously explained, this may result in the bit beginning to precess or "walk" around the hole in the opposite direction to the direction of rotation of the bit, and this action initiates bit whirl.

The present invention provides an arrangement for deliberately imparting an imbalance force to the bit and disposing a low friction wear pad at the gauge in the direction of the imbalance force so that this gauge portion tends to slip on the surface of the gauge portion, thus preventing precession from occurring. Preferably the deliberate imbalance is greater than that typically found, due to manufacturing tolerances etc., in conventional PDC drill bits, i.e. is greater than 10%, and is more preferably greater than 15%.

Since, in accordance with the invention, the imbalance of the bit is deliberately effected by the design of the bit, the direction of the imbalance force is controlled and predetermined, enabling a low friction wear pad to be positioned on the gauge in the appropriate location to react the imbalance force.

Figure 3:
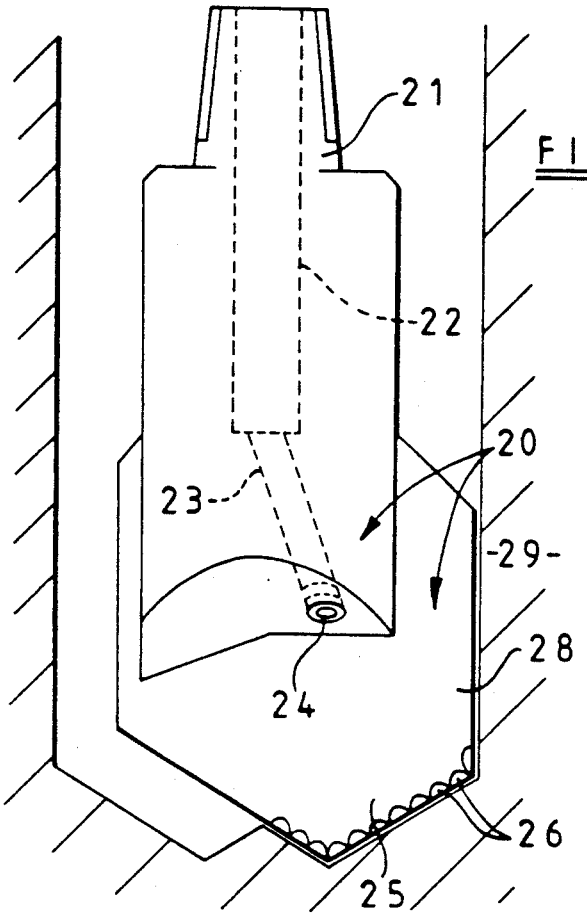
FIG. 3 is a diagrammatic longitudinal section through a single bladed PDC drill bit according to the present invention.
Figure 4:
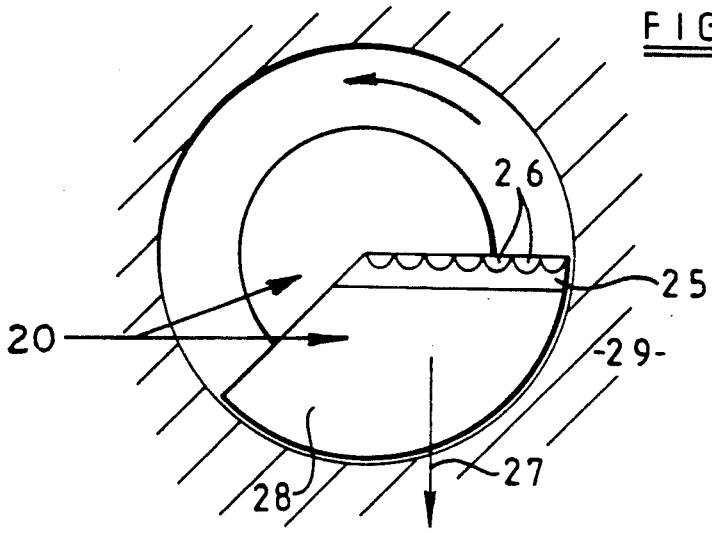
FIG. 4 is a diagrammatic end elevation of the drill bit shown in FIG. 3.

FIGS. 3 and 4 illustrate a drill bit in accordance with the invention, some features, such as some nozzles and ducts for drilling fluid, being omitted for clarity.

It is common practice, in PDC drill bits, to mount the cutting elements side-by-side along blades which project from the end surface of the bit body. For example, the prior art drill bit shown in FIGS. 1 and 2 incorporates nine such blades. It has been found that there may be advantage in reducing the number of such blades, particularly for use in drilling sticky formations in water based mud. This is largely because a reduction in the number of blades allowed larger front exposure, that is to say a large cavity and forwardly facing area in front of each blade. Bits with as few as two blades have been made experimentally. However, regardless of the number of blades it has hitherto always been considered that the arrangements should be generally symmetrical so as to provide a nearly balanced drill bit.

FIGS. 3 and 4 show an arrangement in accordance with the present invention wherein the drill bit is formed with only a single, generally radially extending blade.

Referring to FIGS. 3 and 4, there is shown a rotary drill bit comprising a bit body 20 having a shank 21 for connection to a drill string and a central passage 22 for supplying drilling fluid through bores 23 to nozzles 24 opening out to the face of the bit.

Mounted on the face of the bit is a single generally radially extending blade 25 which carries a plurality of cutting structures 26 disposed side-by-side along the leading edge of the blade.

Each cutting structure 26 may comprise a circular, or part-circular, preform cutting element mounted on a carrier in the form of a stud which is secured, for example by brazing or shrink fitting, in a socket in the bit body. Each cutting element typically comprises a thin table of polycrystalline diamond bonded to a less hard substrate, usually tungsten carbide, the substrate in turn being bonded to the carrier. However, the particular nature of the cutting structures does not form a part of the present invention, and it will be appreciated that any other appropriate form of cutting structure could be employed. For example, a single elongate cutter might be provided, extending along the blade 25 to provide a substantially continuous cutting edge. Although it is preferable that all of the cutting elements should be mounted in a single blade, the invention does not exclude arrangements in which a few cutting elements are also mounted elsewhere on the bit body.

The use of only a single blade 25 creates a substantial imbalance in the drill bit with a resultant sideways reaction force, indicated at 27 in FIG. 2, resulting from the combination of centrifugal forces and the cutting forces acting on the cutting structures 26.

The resultant force 27 is balanced by the reaction of the formation on a low friction wear pad 28 which extends around the gauge portion of the bit rearwardly of the cutting elements 26 with respect to the normal direction of forward drilling rotation of the bit (as indicated by the arrow). The leading edge of the pad is in the vicinity of the outer extremity of the blade 25, and the pad extends rearwardly of the blade through an angle which is preferably in the range of 100° to 225° . In the particular arrangement shown the angular extent of the pad is approximately 130 °.

Instead of the single low friction wear pad shown in FIG. 2, two or more such wear pads may be provided, spaced angularly apart. The surface of the low friction wear pad 28 is in sliding engagement with the surface of the formation 29 and the surface of the wear pad 28 may be rendered wear-resistant by the application thereto of a smooth thin layer of polycrystalline diamond material by the process known as chemical vapour deposition, or CVD.

The present invention is not limited to the particular form of low friction wear pad shown and any other suitable form of low friction pad may be provided, for example as described and claimed in British Patent application No. 8926689-4.

The arrangement described in FIGS. 3 and 4 provides a substantial front exposure of the cutting structures 26, which is known to be of benefit for fast drilling. The combination of the imbalance force 27, as the result of employing a only single cutter-carrying blade, and a low friction wear pad to transmit this force to the formation will result in high stability of the drill bit and substantial reduction or elimination of the tendency of the bit to whirl, as previously described.

I claim:

1. A rotary drill bit comprising a bit body having a shank for connection to a drill string and a passage for supplying drilling fluid to the face of the bit, which carries a plurality of preform cutting elements each formed, at least in part, from polycrystalline diamond, the bit body being formed with a single blade extending outwardly away from the central rotational axis of the bit body, at least the majority of said cutting elements being disposed side-by-side along said blade whereby a resultant radial force is caused to act on the bit in use, and the gauge of the bit body including at least one low friction bearing pad which extends around the gauge rearwardly of the blade, with respect to the normal direction of forward drilling rotation of the bit, so as to transmit the resultant radial force acting on the bit, in use, to the part of the formation which the bearing paid is for the time being engaging.

2. A rotary drill bit according to claim 1, wherein the single blade extends substantially radially with respect to the axis of rotation of the bit.

3. A rotary drill bit according to claim 1, wherein the leading edge of the low friction bearing pad is in the vicinity of the outer extremity of said single blade.

4. A rotary drill bit according to claim 1, wherein the angular extent of the low friction bearing pad, around the gauge, is in the range of 100° to 225° .

* * * * *